US007861353B2

(12) United States Patent
Lewis et al.

(10) Patent No.: US 7,861,353 B2
(45) Date of Patent: Jan. 4, 2011

(54) GLOVE/MITTEN ERASER

(76) Inventors: Duane Lewis, 2001 S. Michigan Ave., Apt. 18Q, Chicago, IL (US) 60616; Aysia R. Lewis, 2001 S. Michigan Ave., Apt. 18Q, Chicago, IL (US) 60616; Diane Lewis, 2001 S. Michigan Ave., Apt. 18Q, Chicago, IL (US) 60616

( * ) Notice: Subject to any disclaimer, the term of this patent is extended or adjusted under 35 U.S.C. 154(b) by 976 days.

(21) Appl. No.: 11/713,487

(22) Filed: Mar. 3, 2007

(65) Prior Publication Data

US 2007/0204419 A1 Sep. 6, 2007

Related U.S. Application Data

(60) Provisional application No. 60/778,618, filed on Mar. 3, 2006.

(51) Int. Cl.
*A47L 13/18* (2006.01)

(52) U.S. Cl. ..... 15/104.002; 15/227; 15/105

(58) Field of Classification Search ..... 15/227, 15/105, 105.51, 118, 104.001, 104.002; 2/158–161.2, 2/161.6

See application file for complete search history.

(56) References Cited

U.S. PATENT DOCUMENTS

| | | | | |
|---|---|---|---|---|
| 1,502,798 | A * | 7/1924 | Phoenix et al. | 15/227 |
| 1,941,320 | A * | 12/1933 | Pamplin | 401/7 |
| 6,529,121 | B2 * | 3/2003 | Bush | 340/326 |
| 6,779,199 | B1 * | 8/2004 | O'Dea et al. | 2/161.6 |
| 2007/0083979 | A1 * | 4/2007 | Daniels | 2/160 |

FOREIGN PATENT DOCUMENTS

JP 2003-38405 * 2/2003

OTHER PUBLICATIONS

Computer generated English translation of JP 2003-38405, Feb. 2003, Haraoka.*

* cited by examiner

*Primary Examiner*—Lauren C Guidotti
(74) *Attorney, Agent, or Firm*—Justin Lampel

(57) ABSTRACT

The present invention generally relates to an eraser for chalkboards, blackboards, markerboards, or whiteboards and the like. The eraser is worn on the hand of a person and at least the palm of the glove/mitten has an eraser surface for erasing. The glove/mitten is especially suitable for use in a classroom.

1 Claim, 3 Drawing Sheets

GLOVE/MITTEN ERASER

BACKGROUND OF THE INVENTION

This application is based off of and claims the priority of U.S. Provisional Application No. 60/778,618 filed on Mar. 3, 2006.

The present invention generally relates to an eraser for chalkboards, blackboards, markerboards or whiteboards and the like. The eraser is worn on the hand of a person and at least the palm of the glove/mitten has an eraser surface for erasing. The glove/mitten is especially suitable for use in a classroom or office.

It is estimated that there are over seventy-six million students ranging from kindergarten to graduate school in the United States. Almost all of these students encounter a chalkboard, blackboard, markerboard or whiteboard each day. Further, tens of millions of adults encounter chalkboards, blackboards, markerboards or whiteboards in the workplace. As a result, Americans spend a great deal of time writing on, and therefore erasing, chalkboards, blackboards, markerboards and whiteboards. Typically, rectangular-shaped erasers are used to accomplish all this erasing. Although these rectangular-shaped erasers may accomplish there desired function, they are limited in function. Accordinlgly, attempts have been made to create erasers for chalkboards, blackboards, markerboards and whiteboards which fit on the hand of a person like a glove or mitten.

U.S. Pat. No. 7,086,094 to Ismailyan discloses an eraser glove for use erasing markings from a board, chalkboard or whiteboard, by a user having a hand and wrist. The eraser glove has an elastic wristband and a form-fitting glove having three half-fingers for covering a thumb, ring finger, and pinkie finger of the hand of the user. The elastic wristband secures around the wrist of the user for ensuring a secure comfortable fit. An absorbent layer is coupled to the form-fitting glove for capturing erased markings from the board.

U.S. Publication No.: 20030213081 to Garcia discloses a hand-mounted eraser for usage upon chalkboards, blackboards, markerboards, and similar flat surfaces. In the preferred mode of the invention, an elongated eraser is attached to the hand by a ring member around the smallest finger and strap member around the wrist. The eraser is configured generally parallel to the smallest finger, running along the exterior thereof. This allows the user to comfortably write at a workboard while wearing the eraser. As such, the invention provides great convenience, as the user need not put down a writing instrument to pick up an eraser while using the workboard. An additional benefit of the present invention lies in the fact that the eraser prevents chalk, ink, or markings from a user's hand from being placed on additional objects, such as transparencies used in connection with overhead projectors.

However, these inventions are also limited in function and do not have the features of the present invention. A need, therefore, exists for an improved eraser for a chalkboard, blackboard, markerboard or whiteboard which overcomes the existing deficiencies.

SUMMARY OF THE INVENTION

The present invention generally relates to an eraser for chalkboards, blackboards, markerboards or whiteboards and the like. The eraser is worn on the hand of a person and at least the palm of the glove/mitten has an eraser surface for erasing. The glove/mitten is especially suitable for use in a classroom.

In the preferred embodiment, an eraser for wearing on a hand of a person is provided having: a front surface worn over the palm of a hand; a back surface worn over the back of the hand; an opening for inserting or removing the hand into the eraser, and a pouch located on the back surface of the eraser wherein the pouch may store an item.

In an embodiment, the pouch is at least partially transparent.

And in an embodiment, the eraser has a magnet attached to the front surface or back surface.

In yet another embodiment, the eraser has a loop portion wherein the loop portion is used to secure the eraser on a hook.

In still another embodiment, the eraser has a noise making device attached to the front surface or back surface.

In an embodiment, the front side of the eraser has multiple layers which may be discarded after they perform their function.

In still another embodiment, the multiple layers may each have a tab for grasping and removing the individual layers.

For a more complete understanding of the above listed features and advantages of the eraser, reference should be made to the following detailed description of the preferred embodiments and to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

The present invention generally relates to an eraser for chalkboards, blackboards, markerboards or whiteboards and the like. The eraser is worn on the hand of a person and at least the palm of the glove/mitten has an eraser surface for erasing. The glove/mitten is especially suitable for use in a classroom.

Figure 1:
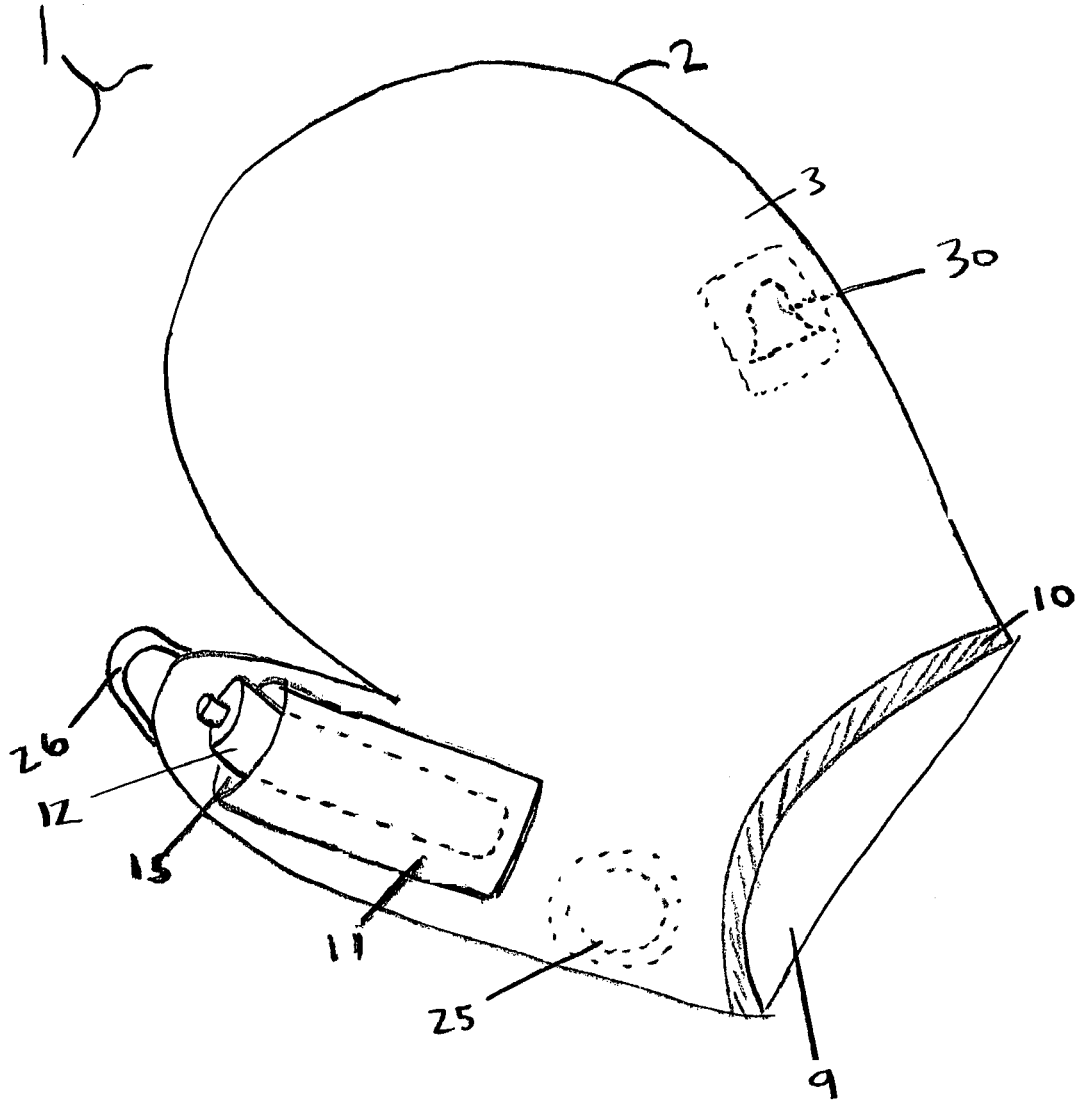
FIG. 1 illustrates a mitten shaped eraser for a chalkboard, blackboard, markerboard or whiteboard.

Referring now to the drawings wherein like numerals refer to like parts, FIG. 1 generally illustrates an eraser 1 of the present invention wherein the eraser 1 is generally shaped as a mitten. More specifically, the eraser 1 may have two separate fittings, one for the thumb and the other for the remaining fingers. Having a separate fitting for the thumb helps stabilizes the mitten on the hand. The eraser 1 may be produced in various sizes or may be produced in a one-size-fits-all embodiment. Alternatively, the eraser 1 may have only one fitting which may accept the thumb and other fingers.

The eraser 1 may have a front side 2, a back side 3 and an opening 9. The opening 9 of the eraser 1 may be used so that the person may insert and/or remove his or her hand from the eraser 1. The front side 2 of the eraser 1 may cover the palm side of the hand or a person and the back side 3 of the eraser 1 may cover the back side of the hand of a person. Although both the front side 2 and the back side 3 may be constructed from any material which may accomplish the desired function, the front side 2 of the eraser 1 is preferably constructed from plastic, rubber, leather, canvas, cotton, foam or felt. The material chosen for the front side 2 of the eraser 1 should be chosen so that the front side 2 of the eraser 1 may remove chalk, marker or the like when the eraser 1 is rubbed against the chalk or marker.

The user may use the eraser 1 to remove chalk or marker from the chalkboard, is blackboard, markerboard or whiteboard while allowing the hand to stay clean from marker or chalk. To help secure the eraser 1 onto the hand of the user, the eraser 1 may have an elastic band 10 near the opening 9 of the eraser 1.

The front side 2 and/or the back side 3 of the eraser 1 may also have a magnet 25 which may be used to secure the eraser 1 to the chalkboard, blackboard, markerboard, whiteboard or any metallic surface. In an embodiment, the magnet 25 may be sewn into the eraser 1 and, therefore, may not be visible. Alternatively to, or in addition to, the magnet 25, the eraser 1 may have a loop portion 26 for hanging the eraser 1 on a hook. As a result, the user may easily find the eraser 1. Finally, in an embodiment, the eraser 1 has a noise making device 30, such as bells, which may be used to gain the attention of students. The noise making device 30 may be located on the front side 2, the back side 3 or located within the interior of the eraser 1 so that the user may activate the noise making device with his or her hand.

Figure 3:
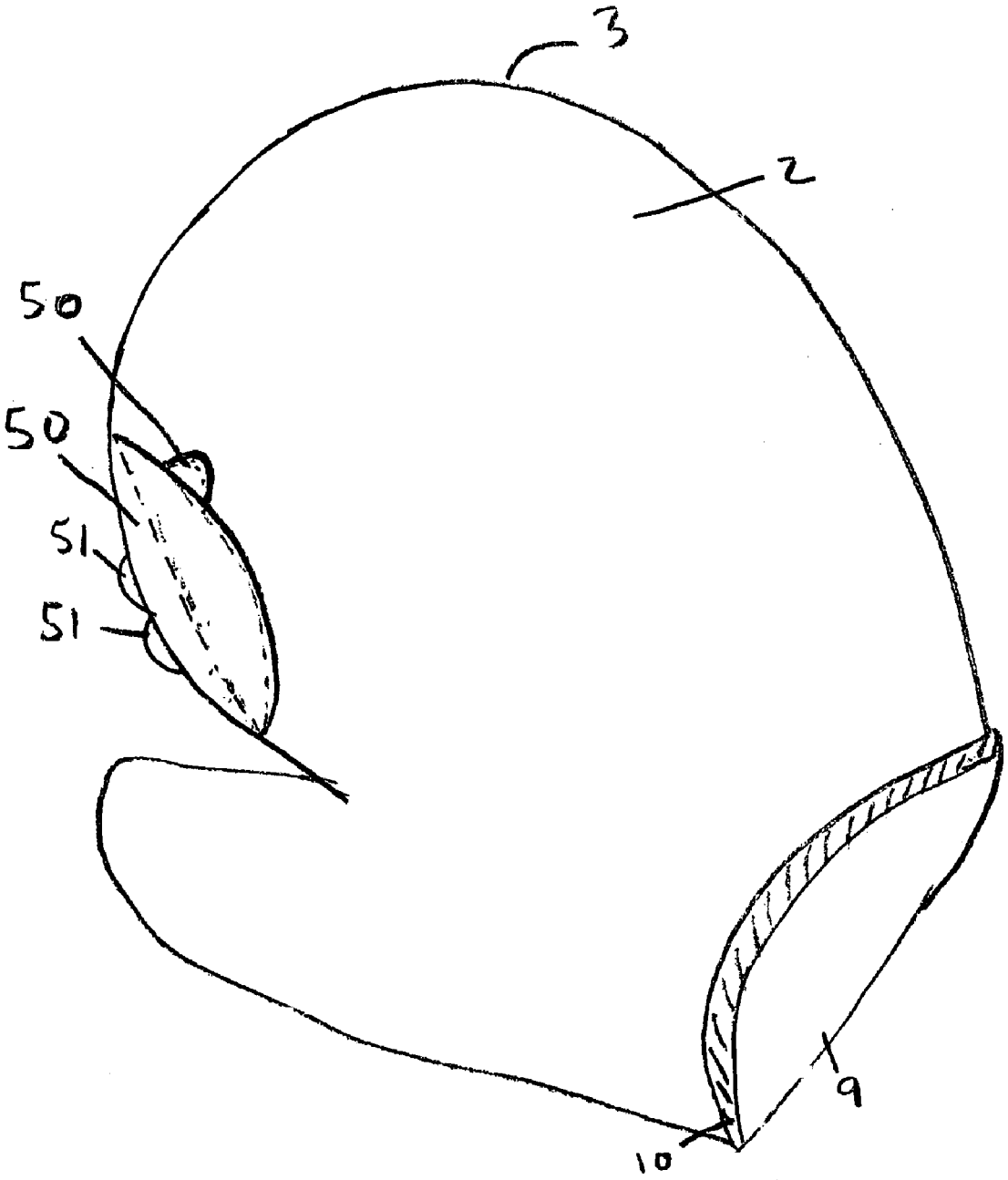
FIG. 3 illustrates an eraser of the present invention wherein the eraser has multiple removable layers on a front side of the eraser and wherein a single layer is partially removed.

In an embodiment, the erasing material of the front side 2 of the eraser 1 may also have layers 50 (See FIG. 3). When one of the layers 50 becomes unusable as a result of being saturated with chalk and or marker, the user may simply peal off a layer 50 and use the clean layer 50 immediately beneath the discarded layer 50. Further, a tab 51 may be located on the side of each layer 50 so as to allow the user to easily grasp the individual layers 50 for removal and or disposal. The layers 50 may be held together by a semi-permanent adhesive. FIG. 3 illustrates a single layer 50 partially pulled back to reveal a clean under layer 50.

Figure 2:
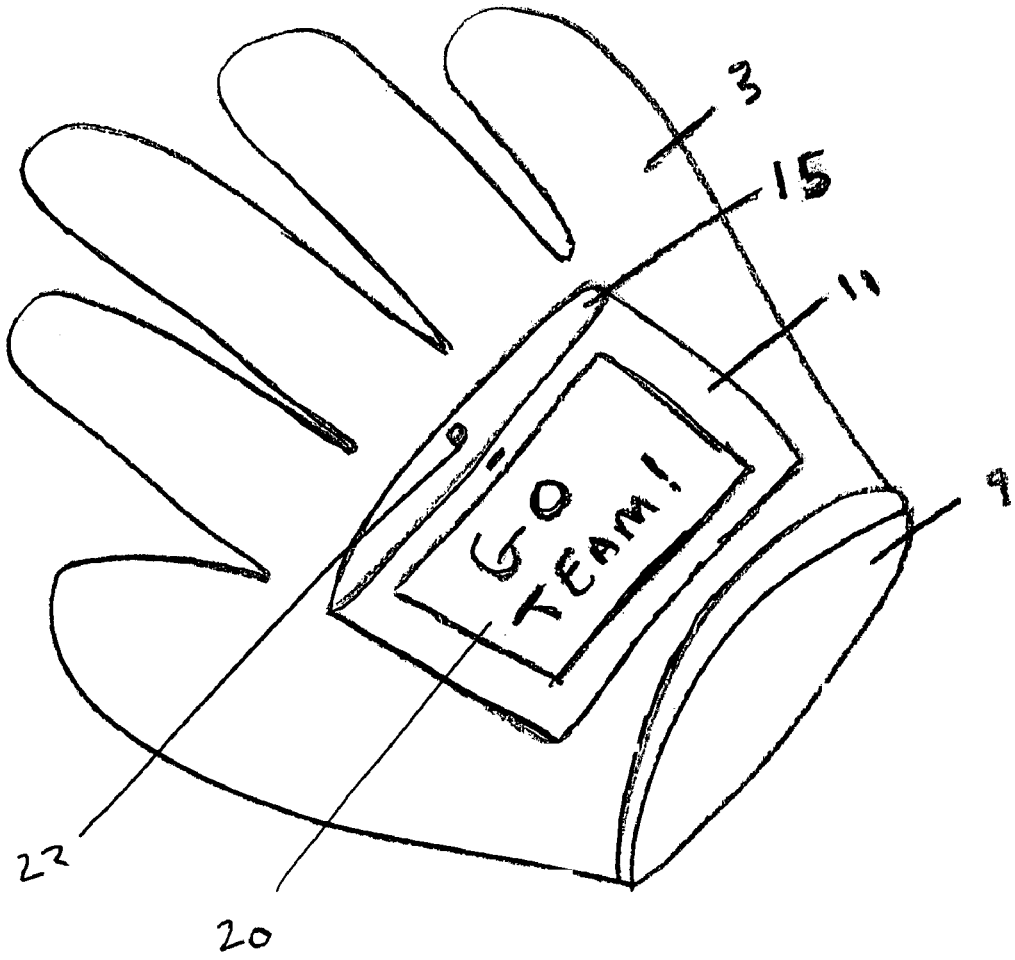
FIG. 2 illustrates a glove shaped eraser for a chalkboard, blackboard, markerboard or whiteboard.

Referring now to FIG. 2, the eraser 1 may be generally in the shape of a glove. The extra material between the fingers of the mitten as opposed to a glove may allow the user to more easily remove the chalk or marker from the chalkboard, blackboard, markerboard or whiteboard.

The back side 3 of the eraser 1 may have a pouch 11 for securing an item. The pouch 11 may have an opening 15. FIG. 1 illustrates the pouch 11 being located on the back side 3 of the thumb portion of the eraser 1; however, the pouch 11 may be located anywhere on the eraser 1. The pouch 11 may be particularly suitable for holding a writing utensil 12, such as a marker or a piece of chalk.

Instead of, or in addition to, the pouch 11 being used to store, for example, a writing utensil 12 the pouch 11 may be used to display an image 20, such as a photograph (See FIG. 1). If the pouch 11 is used, for example, to display an image 20, the exterior surface of the pouch 11 must be made from a transparent material. The image 20 may be permanently secured within the pouch 11 by, for example, sealing the pouch 11 after the image 20 is inserted. Alternatively, the pouch 11 may temporarily store the image 20 so as to allow the user to periodically change the image 20. The pouch 11 may also be used to secure such items as a calendar, keys or the like. The pouch 11 may further have a temporary securing mechanism 23 such as, for example, a zipper, buttons, or a hook and loop fastener.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An eraser worn on the hand of a person comprising:

a front surface worn over the palm of a hand;

a back surface worn over the back of the hand;

a magnet secured to the front or back surface wherein the magnet secures the eraser to a chalkboard, blackboard, whiteboard or markerboard;

a plurality of layers on the front surface wherein the plurality of layers are individually used for cleaning and wherein an individual layer may be removed to reveal a clean layer underneath and wherein the plurality of layers are held together by a semi-permanent adhesive and wherein the plurality of layers each have a tab for allowing grasping and removing one of the plurality of layers;

an opening for inserting or removing the hand into the eraser;

a pouch located on the back surface of the eraser wherein the pouch may store an item; and a noise making device attached to the front surface or back surface.

* * * * *